US006881714B2

(12) United States Patent
Bargaje et al.

(10) Patent No.: US 6,881,714 B2
(45) Date of Patent: Apr. 19, 2005

(54) WASHING SYSTEM

(75) Inventors: Vijaye Milind Bargaje, Whitefield (IN); Vidur Behal, Mumbai (IN); Kripa Devagna Mody, Whitefield (IN); Glyn Roberts, Whitefield (IN); Paul Johan Birker, Vlaardingen (NL)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/299,493

(22) Filed: Nov. 19, 2002

(65) Prior Publication Data

US 2003/0148903 A1 Aug. 7, 2003

(30) Foreign Application Priority Data

Nov. 19, 2001 (IN) ..... 1091/MUM/01

(51) Int. Cl.[7] ..... C11D 17/00

(52) U.S. Cl. ..... 510/407; 417/365; 417/376; 8/137

(58) Field of Search ..... 510/407, 417, 510/365, 376, 412, 285, 286, 506; 8/137

(56) References Cited

U.S. PATENT DOCUMENTS 4,176,080 A * 11/1979 Wise et al. ..... 252/162
5,962,391 A 10/1999 Oldenhove
6,706,678 B1 * 3/2004 Bargaje et al. ..... 510/407
6,727,218 B1 * 4/2004 Bargaje et al. ..... 510/407

FOREIGN PATENT DOCUMENTS

| | | | |
|---|---|---|---|
| EP | 0620270 A2 | | 10/1994 |
| GB | 1247189 | | 9/1971 |
| WO | 82/02218 | * | 7/1982 |
| WO | 01/90474 | | 11/2001 |

OTHER PUBLICATIONS

International Search Report Application No. PCT/EP 02/12036 mailed Feb. 21, 2003.

* cited by examiner

*Primary Examiner*—Necholus Ogden
(74) *Attorney, Agent, or Firm*—Ronald A. Koatz

(57) ABSTRACT

The invention relates to a cleaning composition suitable for manually cleaning substrates. The composition comprises at least two immiscible liquid phases having one liquid-liquid interface with an interfacial tension of more than 5 mN/m, the difference in density between the two liquid phases being not more than 0.2 g/cc. After agitation, the composition is applied to the substrate to be cleaned, and subsequently friction is applied to the substrate. The composition provides for the required stability after agitation, and gives good detergency, particularly as regards particulate soil.

14 Claims, No Drawings

WASHING SYSTEM

TECHNICAL FIELD

The present invention relates to cleaning/washing compositions comprising liquid immiscible phases and having a high interfacial tension, wherein the density of the immiscible phases is similar. The invention also relates to a process of cleaning using the cleaning/washing compositions of the invention. The cleaning/washing compositions are particularly useful for domestic laundering of fabrics, including clothes, soft furnishing and carpets, especially in direct applications/hand wash conditions.

BACKGROUND AND PRIOR ART

Conventionally fabric is cleaned using water and a detergent composition which is known as wet washing. Surfactants adsorb on both fabric and soil and thereby reduce the respective interfacial energies and this facilitates removal of soil from the fabric.

Alternatively cleaning can be carried out by dry cleaning wherein organic solvents are used for cleaning. Dry cleaning is traditionally an industrial laundering process carried out in a washing machine. The organic solvent helps in the removal of oily soil in the presence of detergents. The particulate soil is largely removed by providing agitation.

Whilst it is desirable to add surfactants to enhance dry cleaning, surfactants are insoluble in the organic solvent. A small amount of water is added to the organic solvent in a dry cleaning process to facilitate surfactant dissolution. Improved oily soil removal is achieved by a small reduction in interfacial tension.

Our earlier-filed co-pending application WO-A-01/90474, published 29 Nov. 2001 discloses a process of cleaning fabric using a cleaning/washing system of at least two immiscible liquid phases with an interfacial tension greater than 5 mN/m, under agitation. The process uses very much reduced levels of conventional detergent surfactants. The system is especially suitable for removing particulate soil.

The process as disclosed in WO-A-01/90474 requires agitation, which may be provided by any suitable means used for domestic laundering or industrial laundering. The invention is especially suitable for use with washing machines.

Manual washing of fabrics and hard surfaces using bars, powders and pastes is a common method of cleaning, especially in developing countries. Detergent compositions in bar form are particularly popular and cleaning is done by applying the bar to the substrate. Further cleaning is done by applying mechanical force by means of a suitable implement like a brush, pouf, etc. Water used for cleaning is poured over the fabric as and when required.

Fabrics are also known to be soaked in a detergent solution and then further cleaned by applying mechanical force.

The methods used for manual washing are time consuming and tedious and require a lot of effort on the part of the consumer. The process also requires a large amount of water (for cleaning and rinsing), a resource that is not always readily available in developing countries. Further, the cleaning obtained is often not completely satisfactory, in particular as regards the removal of particulate soil.

Hence there has been a need to develop a simple method of manual cleaning that gives good detergency, in particular for particulate soil, does not require large quantities of water and provides for good cleaning with less effort than required in current manual cleaning using detergent products.

Cleaning systems, as disclosed in WO-A-01/90474, give enhanced detergency, in particular for removal of particulate soil. The cleaning systems can be used for manual washing of substrates. As in conventional manual cleaning, washing can be carried out by pouring the two liquids separately on the substrate and then cleaning the substrate by means like brushing. However, the mixing of the two liquids is poor and the liquids are likely to separate quickly under gravity resulting in impaired cleaning.

It is also possible to carry out manual cleaning by mixing the two immiscible liquids by agitation prior to pouring on to the substrate or by introducing the fabric into the mixture and then agitating the same. However, the mixture must remain stable for a few seconds after agitation of the mixture and prior to subsequent steps like rinsing in order to provide for cleaning. This can be achieved by adding surfactants; however, this will reduce the interfacial tension. Further, not all cleaning systems disclosed in WO-A-01/90474 provide for mixtures of immiscible liquids that are stable for a short period of time before carrying out further operations like rinsing etc.

We have now found that the above drawbacks can be overcome to a significant extent by using a cleaning/washing composition comprising two immiscible phases having a high interfacial tension wherein the density of the two immiscible phases is the same or similar. The cleaning/washing composition of the invention is stable after agitation and gives good detergency, in particular for particulate soil. A process for cleaning using the cleaning compositions of the invention is also provided for. It is required that the cleaning composition be suitably agitated before or after contacting with the substrate. Subsequent to cleaning, friction is applied to the substrate by rubbing, by means of a brush, pouf, sponge or any other means known in the art. Advantageously, the process uses less water than conventional detergent systems for manual cleaning.

SUMMARY OF THE INVENTION

The present invention relates to a cleaning/washing composition for manual cleaning comprising at least two immiscible phases and having an interfacial tension greater than 5 mN/m wherein the density of the two immiscible phases is the same or similar. The difference in density between the two phases should not be greater than 0.2 g/cc. A process for cleaning using the cleaning compositions of the invention is also provided for. It is required that the cleaning/washing composition be suitably agitated before or after contacting with the substrate. The cleaning/washing composition is stable and does not show phase separation during agitation as well as before rinsing. Subsequent to manual cleaning, friction is applied to the substrate by rubbing, by means of a brush, pouf, sponge or any other means known in the art. The cleaning/washing composition of the invention gives good detergency, in particular for particulate soil and may or may not use water for cleaning.

DEFINITION OF THE INVENTION

According to the first aspect of the invention, there is provided a cleaning/washing composition for manual cleaning comprising at least two liquids, having one liquid-liquid interface with an interfacial tension of at least 5 mN/m, wherein the difference in density of the liquids in the two phases is not greater than 0.2 g/cc.

Preferably, the difference in density of the liquids in the two phases is not greater than 0.1 g/cc, more preferably the difference in density of the liquids in the two phases is not greater than 0.05 g/cc and most preferably the difference in density of the liquids in the two phases is not greater than 0.03 g/cc. It is further preferred that at least one of the liquids is water.

According to the second aspect of the invention, there is provided a process of manual cleaning comprising the steps of:

a) agitating the cleaning/washing composition comprising at least two liquids, having one liquid-liquid interface with an interfacial tension of at least 5 mN/m, wherein the difference in density of the liquids in the two phases is not greater than 0.2 g/cc;

b) contacting the cleaning/washing composition with the substrate and;

c) applying a friction means to the substrate;

d) rinsing the substrate with a suitable liquid.

Friction means as known in the art include a brush, sponge, pouf are suitable for the invention. Rubbing the substrates with each other may also provide the necessary friction.

The vehicle for contacting the mixture with the substrate and the source of friction can be located in the same device.

DETAILED DESCRIPTION OF THE INVENTION

The present invention relates to cleaning/washing compositions comprising immiscible liquids, having one liquid-liquid interface with an interfacial tension of at least 5 mN/m, wherein the density of the liquids is the same or similar. The difference in density of the immiscible liquids is not greater than 0.2 g/cc. The cleaning/washing compositions are suitable for manual cleaning.

Preferably, the difference in density of the liquids in the two phases is not greater than 0.1 g/cc, more preferably the difference in density of the liquids in the two phases is not greater than 0.05 g/cc and most preferably the difference in density of the liquids in the two phases is not greater than 0.03 g/cc.

It is possible to use two immiscible liquids with the same or similar density. Mixtures of miscible solvents may also be used in the two phases, provided there are two immiscible phases and the density of the two phases is the same or similar.

Density can be measured by any of the methods known in the art.

The interfacial tension of at least one liquid-liquid interface in the composition is at least 5 mN/m, preferably at least 8 mN/m, and more preferably at least 10 mN/m. Suitably the interfacial tension is at least 15 mN/m, advantageously at least 20 mN/m and desirably at least 35 mN/m. Interfacial tension may be measured using various techniques, such as sessile drop, pendant drop, spinning drop, drop volume or Wilhelmy plate method. For the purposes of the present invention, interfacial tension is measured by the Wilhelmy plate method, using a Kruss Processor Tensiometer K12, at 25° C.

Liquid Components

Solvents that can be used include water, alcohols, esters, ethers, ketones, hydrocarbons, paraffins, aromatic solvents, halogenated solvents, heterocyclics etc. Mixtures of these can be used such that at least one interface exists and the interfacial tension is greater than 5 mN/m. Typically, such a mixture is a mixture of perchlorethylene and petroleum ether as the less polar liquid, and water as the more polar liquid.

Preferred less polar solvents have a carbon chain length of at least 4, preferably more than 6. They may be selected from branched and linear alkanes (chemical formula CnH2n+2 where n is at least 4), including but not limited to hexane, heptane, octane, nonane, decane, dodecance, tridecane, tetradecane, pentadecane etc. and mixtures thereof. Commercially available mixtures of this type include Isopar L (C11–C15 alkanes—ex-Exxon) and DF2000 (C11–C15 isoalkanes ex-Exxon). Branched and linear alkenes with more than 6 carbon atoms including but not limited to octenes, nonenes, decenes, undecenes, dodecenes etc, with one or more double bonds and mixtures thereof may also be used.

Ethers including fluoroethers such as methoxy nonafluorobutane HFE-7100 (i.e. C4F9-OCH3 ex-3M) and ethoxy nonafluorobutane HFE-7200 (i.e. C4F9-OC2H5 ex-3M), esters, such as dibutyl phthalate, dioctyl phthalate and terpenes, such as limonene or mixtures thereof may also be used. Preferred esters are C8–C24 saturated and/or unsaturated fatty acid methyl esters, particularly C12–C18 fatty acid methyl esters such as methyl laurate, methyl myristate, methyl stearate, methyl linoleate and methyl linolenate.

Polydimethylsiloxane solvents with more than 3 SiO units may also be used. Linear and cyclic siloxanes known as Lx and Dx where x is greater than three are suitable for this technology. Specific examples include octamethylcyclotetrasiloxane(D4) (ex-Dow Corning), decamethylcyclopentasiloxane (D5), dodecamethylcyclohexasiloxane (D6), decamethyltetrasiloxane (L4) and dodecamethyl pentasiloxane(L5).

Preferably the amount of the most polar liquid in the composition is from 10.1 to 90% by volume, preferably from 25 to 90%, more preferably from 40 to 90% and most preferably from 60 to 90%. Water is an especially preferred polar liquid.

Benefit Agents/Optional Ingredients

Benefit agents and other optional ingredients may also be included in the compositions of the invention.

The benefit agents may be water-soluble or soluble in the organic solvents and may be selected from fluorescers, enzymes, bleaches, dye transfer inhibitors, optical brighteners, soil release polymers, fabric softeners, anti-redeposition agents, electrolytes, perfume etc. The level of these agents range between 0.01–200 grams per liter. The level of the fluorescers is preferably in the range 0.001–0.5%, dye transfer inhibitors in the range 0.01–10 g/l, fabric softeners 0.01–200 g/l and anti-redeposition agents 0.001 to 10 g/l.

Optionally, it is possible to incorporate other conventional detergent ingredients such as builders, hydrotopes, polymers, fatty acids or fatty amines into the immiscible liquid system. In principle, limited amounts of surfactant may be present provided that the interfacial energy is not reduced significantly. However, the compositions are preferably free of surfactant.

Fatty acids and fatty amines may be selected from any one or more with carbon chain length ranging from $C_{12}$ to $C_{22}$, and preferably with a chain length of $C_{18}$ to $C_{22}$.

Suitable builders include, for example, salts of ethylene diaminetetraacetic acid (EDTA), sodium tripolyphosphate (STPP), alkali metal aluminosilicates (zeolites), alkali metal carbonate, tetrasodium pyrophosphate (TSPP), citrates, sodium nitrilotriacetate (NTA), and combinations of these. Builders are suitably used in an amount ranging from 0.01–1% by weight. Preferably inorganic builders are used.

Polymers may also be added to the formulation as optional ingredients. Examples of such polymers include starch and modified starch, dextrins, gums, cellulose and modified cellulose or their mixtures thereof as well as synthetic polymers like poly(vinyl alcohol), poly (vinyl pyrrolidone).

Method of Cleaning

The cleaning/washing composition of the invention is agitated manually, for example by thoroughly shaking the composition. It is also possible to use an implement for mixing the components like a rod or a stick.

Preferably the agitation time is at least 5 minutes, more preferably at least 15 minutes and most preferably at least 60 minutes.

After agitation of the cleaning/washing composition, the cleaning/washing composition is contacted with the substrate, for example by pouring or spraying over the substrate. A cloth:liquor ratio of 1:3 to 1:20, as used in most domestic laundering applications, is suitable for the invention. The cleaning/washing composition should wet the substrate.

Subsequently, the substrate is cleaned by a friction means, for example a brush, sponge, pouf, scrubber or other cleaning implements known in the art. Net like structures used in dish wash applications as well as cleaning objects with dimpled surfaces are also suitable for providing friction when applied on to the substrate.

It is possible to provide a suitable device or container with the cleaning/washing composition for agitating the cleaning/washing composition. The device or container may contain suitable means for agitating the cleaning/washing composition and a surface for producing friction.

Further, the invention also encompasses a kit comprising the cleaning/washing composition of the invention and a suitable friction means. Suitable friction means include a brush, sponge, pouf etc. Other kit forms—for example the cleaning/washing composition of the invention and a washboard or a kit comprising the cleaning/washing composition of the invention, a friction means and a washboard are also possible to carry out the cleaning process of the invention.

EXAMPLES

The invention is further illustrated by the following non-limiting examples, in which parts and percentages are by weight unless otherwise stated.

Preparation of Soiled Fabric Pieces 50 mg Carbon soot N220, Carbot (ex Union Carbide) was added to a 1 g/l solution of sodium dodecyl sulphate in 100 ml of deionised water and the mixture dispersed evenly by sonication in an ultra-sound bath for a minimum of 3 hours. Square (10×10 cm) pieces of desized white cotton fabric are dipped in the above solution for 5 seconds and then taken out. Excess of water is drained and the fabric air dried overnight. Initial reflectance (R460*) is then measured, with contribution from UV radiation removed, using a Macbeth Colour-Eye 7000A reflectometer.

COMPARATIVE EXAMPLE A

Three soiled fabric pieces prepared as given above were placed in a clamp horizontally and then wetted with 25 ml of water. A detergent bar having the composition as given in Table 1 was taken and applied to one side of the fabric pieces 5 times in a back and forth movement (each back and forth movement is taken as 1 application). The fabric pieces were then brushed 10 times using a plastic brush. Brushing involves only the forward movement. The fabric pieces were then rinsed with 25 ml of water. The rinsing procedure was repeated three times. The fabric pieces were allowed to air dry and the reflectance was recorded at 460 nm (R460*), with contribution from ultra-violet radiation removed, using a Macbeth Colour-eye 7000A reflectometer.

TABLE 1

| Ingredients | % (by weight of the bar) |
|---|---|
| Soda | 6 |
| Linear alkylbenzenesulphonate (LAS) | 20 |
| Blue dye | 0.125 |
| China Clay | 8 |
| Aluminum Sulphate | 2.5 |
| Alkaline silicate | 1.5 |
| STPP | 12 |
| Calcite | 40 |
| Calcium Hydroxide | 3 |
| Water | To 100 |

COMPARATIVE EXAMPLES B–G, EXAMPLE 1

Cleaning was done with pure solvents as well as mixtures of solvents. The densities of the solvents are given below:

| Solvent | Density (g/cc) |
|---|---|
| Water | 1 |
| HFE-7100 | 1.53 |
| DF2000 | 0.77 |

The solvent mixtures were agitated before application by taking them in a closed container and then thoroughly shaking the contents and applying immediately to the fabric surface.

Three fabric pieces prepared as given above were clamped and then wetted with 25 ml of the solvent or the solvent mixture. The fabric pieces were then brushed 10 times using a plastic brush; brushing involving only forward movement. The fabric pieces were then rinsed with 25 ml of water. The fabric pieces were air dried and the change in reflectance determined at 460 nm (R460*), with contribution from ultra-violet radiation removed, using a Macbeth Colour-Eye 7000A reflectometer.

The details on the compositions of Comparative Examples B–G and Example 1 and the detergency results are as given in Table 2.

The density difference between the two solvents was greater than 0.2 g/cc in Comparative Examples E–G.

Detergency was measured as the difference between R460* of the soiled fabric and the R460* of the cleaned fabric.

TABLE 2

| Example | Solvent 1 (S1) | Solvent 2 (S2) | Solvent 3 (S3) | Ratio (S1:S2:S3) | Delta ρ | ΔR460* |
|---|---|---|---|---|---|---|
| A | Detergent bar | | | — | N.A.* | 4.0 |
| B | Water | — | — | 1:0:0 | N.A. | 1 |
| C | HFE-7100 | — | — | 1:0:0 | N.A. | 1 |
| D | DF2000 | — | — | 1:0:0 | N.A. | 2 |
| E | HFE-7100 | Water | — | 1:4:0 | 0.53 | 3 |
| F | DF2000 | Water | — | 1:4:0 | 0.23 | 3 |
| G | HFE-7100 | DF2000 | — | 1:2.339:0 | 0 | 1 |
| 1 | HFE-7100 | DF2000 | Water | 1:2.339:3.34 | 0.01 | 9 |

*N.A.—Not Applicable

The data presented in Table 2 clearly shows that density matching of immiscible liquids significantly enhances the cleaning performance of the mixed solvent systems in direct application. These density matched systems also give superior cleaning performance to conventional detergent cleaning.

COMPARATIVE EXAMPLES H–M, EXAMPLE 2

The density of the solvents used in Comparative examples H–M and Example 2 is as given below:

| Solvent | Density (g/cc) |
|---|---|
| Perchloroethylene | 1.62 |
| Petroleum Ether | 0.64 |

The cleaning procedure as used for Comparative examples B–G and Example 1 was followed using different solvents. The details of the solvent composition, density differences and detergency results are presented in Table 3.

TABLE 3

| Example | Solvent 1 (S1) | Solvent 2 (S2) | Solvent 3 (S3) | Ratio (S1:S2:S3) | Delta ρ | ΔR460* |
|---|---|---|---|---|---|---|
| A | Detergent Bar | | | — | N.A. | 4.0 |
| H | Water | — | — | 1:0:0 | N.A. | 1 |
| I | Perchloroethylene (PERC) | — | — | 1:0:0 | N.A. | 1 |
| J | Petroleum Ether (PE) | — | — | 1:0:0 | N.A. | 2 |
| K | PERC | Water | — | 1:4:0 | 0.62 | 3 |
| L | PE | Water | — | 1:4:0 | 0.36 | 3 |
| M | PERC | PE | — | 1:0.272:0 | 0 | 1 |
| 2 | PERC | PE | Water | 1:0.272:2.725 | 0.015 | 9 |

The data presented in Table 3 further establishes that a cleaning/washing composition comprising immiscible liquids having comparable density shows superior detergency to conventional cleaning compositions comprising immiscible liquids in which the density has not been matched.

EFFECT OF ADDITIVES ON CLEANING: COMPARATIVE EXAMPLES N–O, EXAMPLE 3

The cleaning procedure as given in Comparative Examples B–G and Example 1 was followed. Sodium carbonate ($Na_2CO_3$), Tinopal™ and sodium carboxymethyl cellulose (SCMC) which are water soluble additives were added to the systems of Comparative Example O and Example 3 prior to agitation. The cleaning/washing compositions used in the examples and the detergency results are presented in Table 4.

The density of chlorobenzene is 1.1058.

TABLE 4

| Example | Wash system | $Na_2CO_3$ (g/l) | Tinopal (g/l) | SCMC (g/l) | Delta ρ | Detergency R 460* |
|---|---|---|---|---|---|---|
| 1 | Rin Supreme (a commercial detergent) | — | — | — | — | 4.0 |
| 2 | Chlorobenzene | — | — | — | — | 1 |

TABLE 4-continued

| Example | Wash system | $Na_2CO_3$ (g/l) | Tinopal (g/l) | SCMC (g/l) | Delta ρ | Detergency R 460* |
|---|---|---|---|---|---|---|
| 3 | Water | 1.0412 | 0.08 | 1.6 | — | 3 |
| 4 | Chlorobenzene + Water | 1.0412 | 0.08 | 1.6 | 0.1058 | 7 |

Thus, the present invention provides for superior detergency during manual washing. The process is simple and not as labour intensive as conventional methods of manual washing and uses less water for cleaning and rinsing the fabric.

What is claimed is:

1. A cleaning composition, suitable for manual cleaning, comprising at least two immiscible liquid phases comprising a polar solvent and a less polar wherein a liquid-liquid interface between the polar solvent and the less polar solvent has an interfacial tension of more than 5 mN/m, wherein the difference in density of the two immiscible phases is not more than about 0.1 g/cc;

said less polar solvent being a mixture of perchloroethylene and petroleum ether.

2. A composition according to claim 1, wherein the difference in density is not more than 0.05 g/cc.

3. A composition according to claim 1, wherein the difference in density is not more than 0.03 g/cc.

4. A composition according to claim 1, wherein the interfacial tension is at least 8 mN/m.

5. A composition according to claim 1, wherein the interfacial tension is at least 10 mN/m.

6. A composition according to claim 1, wherein the interfacial tension is at least 15 mN/m.

7. A composition according to claim 1, wherein the interfacial tension is at least 20 mN/m.

8. A composition according to claim 1, wherein the interfacial tension is at least 35 mN/m.

9. A composition according to claim 1, wherein two or more miscible liquids of differing densities are combined such that the density of the mixture differs not more than 0.1 g/cc with the density of the liquid phase with which mixture is immiscible.

10. A composition according to claim 1, wherein the density of one liquid phase is increased by soluble or insoluble additives such that the density of this phase differs not more than 0.1 g/cc with the density of the immiscible liquid phase.

11. A composition according to claim 1, wherein the more polar solvent is water.

12. A composition according to claim 11, wherein the amount of water is from 10.1–90% by weight.

13. A process for manually cleaning soiled substrates comprising the steps of a) agitating a composition according to claim 1, b) contacting the substrates with the agitated composition, c) applying friction to the substrates, and d)rinsing the substrates.

14. A kit for carrying out the process of claim 13 comprising a container with a composition according to claim 1 and a friction device.

* * * * *